United States Patent [19]

Holmes

[11] Patent Number: 4,861,224

[45] Date of Patent: Aug. 29, 1989

[54] AERIAL LIFT INCLUDING OVERLOAD SENSING SYSTEM

[75] Inventor: William K. Holmes, Delafield, Wis.

[73] Assignee: Hi-Ranger, Inc., Waukesha, Wis.

[21] Appl. No.: 206,613

[22] Filed: Jun. 14, 1988

[51] Int. Cl.[4] ..... B66C 23/00

[52] U.S. Cl. ..... 414/680; 182/2; 212/261; 212/155; 414/700; 414/708; 414/709

[58] Field of Search ..... 414/699, 700, 706, 708, 414/709, 680; 212/256, 261, 150, 155; 182/2

[56] References Cited

U.S. PATENT DOCUMENTS

| | | | |
|---|---|---|---|
| 3,139,948 | 7/1964 | Rorden | 182/2 |
| 3,841,493 | 10/1974 | Jackson et al. | 212/39 |
| 3,854,593 | 12/1974 | Gross | 212/150 |
| 4,081,055 | 3/1978 | Johnson | 212/256 X |
| 4,178,591 | 12/1979 | Geppert | 340/685 |
| 4,185,280 | 1/1980 | Wilhelm | 340/685 |
| 4,222,491 | 9/1980 | Geppert | 212/153 |
| 4,354,608 | 10/1982 | Wudtke | 212/256 X |
| 4,762,199 | 8/1988 | Holmes | 182/2 |

*Primary Examiner*—Robert J. Spar
*Assistant Examiner*—Donald W. Underwood
*Attorney, Agent, or Firm*—Michael, Best & Friedrich

[57] ABSTRACT

An aerial lift having means for sensing a combination of the load placed on the upper end of the upper boom and the relative position of the upper boom with respect to horizontal and for generating a signal or interrupting supply of hydraulic fluid to the upper boom lift cylinder in the event the moment on the upper boom exceeds a selected moment.

10 Claims, 3 Drawing Sheets

AERIAL LIFT INCLUDING OVERLOAD SENSING SYSTEM

FIELD OF THE INVENTION

The present invention relates to aerial lifts and more specifically to apparatus for providing an overload signal when an excessive load is placed on the boom assembly of an aerial lift.

BACKGROUND PRIOR ART

Aerial lifts of the type including an articulated boom supporting an operator platform or bucket, may also include a jib and winch supported at the end of the boom and permitting the operator to lift and support various loads such as equipment to be installed by an operator supported in the bucket.

In operation of the aerial lift, and particularly aerial lifts including a jib and winch for lifting utility equipment or the like, it is important that the operator not overload the aerial lift boom by attempting to lift an object of excessive weight or an object which may be obstructed. For example, in cold climates an object to be lifted may be frozen in place thereby placing a substantial unexpected load on the aerial lift. Additionally, when the aerial lift bucket is supporting a load, during operation of the aerial lift, the upper boom may move from a first position wherein the length of the moment arm of the vertical force of the load on the boom is sufficiently short that the boom is not overloaded, to a second position wherein the length of the moment arm increases and the load on the boom then exceeds the maximum acceptable load on the boom assembly.

Because the load on the boom is dependent both on the weight of the objects being lifted and the relative position of the upper boom with respect horizontal, successful load sensing systems or overload alarm systems have not been developed.

SUMMARY OF THE INVENTION

The present invention provides an aerial lift having means for sensing a condition wherein the load placed on the hydraulic system supporting the upper end of the boom reaches or approaches a predetermined maximum acceptable load, and the sensing means fully compensates for the relative position of the upper boom with respect to horizontal. In one embodiment of the present invention it includes a means for sounding an alarm or warning device indicating that the load on the boom is approaching a maximum load at that relative position of the upper boom. In another embodiment of the invention, means are provided for interrupting the supply of hydraulic fluid to the hydraulic lift cylinders in the event that the load on the boom exceeds a selected load and to thereby prevent the operator from moving the boom to a position wherein a substantial overload condition will exist.

More specifically, the invention includes an aerial lift including a lower boom having a lower end pivotally joined to a support structure for pivotal movement about a horizontal axis, means for causing pivotal movement of the lower boom with respect to the support structure, and an upper boom pivotally joined to the upper end of the lower boom for pivotal movement about a pivot axis, the upper boom having an upper end adapted to support a load. A hydraulic cylinder causes pivotal movement of the upper boom with respect to the lower boom. The aerial lift also includes compensating means for maintaining the upper boom in a selected position with respect to horizontal during movement of the lower boom with respect to the support structure. Means are further included for providing an overload signal when the load on the upper boom and the relative position of the upper boom with respect to horizontal generate a moment on the upper boom which exceeds a selected maximum moment.

In a preferred form of the invention the means for providing an overload signal includes a sensor for sensing the hydraulic fluid pressure in the upper boom hydraulic lift cylinder.

In one embodiment of the invention an alarm means is operably connected to the sensor for producing an alarm signal in response to a signal from the sensor and is operable to provide an alarm when the load on the upper boom and the relative position of the upper boom generate a moment on the upper boom which exceeds a selected moment.

In one embodiment of the invention means are provided for interrupting movement of the upper boom, this means being operably connected to the means for providing an overload signal and for interrupting operation of the upper boom in the event the load on the upper boom and the relative position of the upper boom generate a moment on the upper boom which exceeds a maximum selected moment.

In one embodiment of the invention the apparatus for causing movement of the upper boom with respect to the lower boom includes a sheave pivotable about the pivot axis of the upper boom and a cable reeved over the sheave, the cable having one end connected to the upper boom and its opposite end connected to the hydraulic cylinder.

In one embodiment of the invention the compensating means includes a sprocket sector supported by the support structure and having a radius about the horizontal pivot axis of the lower boom substantially the same as the radius of the sheave, and a chain is reeved over at least a portion of the sprocket sector, the chain having one end fixed to the support structure and an opposite end connected to the hydraulic cylinder.

In one embodiment of the invention the lower boom includes an intermediate portion comprised of electrically insulative material and the hydraulic cylinder is housed in the lower boom between the electrically insulative intermediate portion and the lower end of the boom. A sensing device including an electrical switch can be connected to the hydraulic lift cylinder without compromising the dielectric characteristics of the lower boom.

Various other features of the invention will be apparent by reference to the following description of a preferred embodiment, from the drawings and from the claims.

Figure 1:
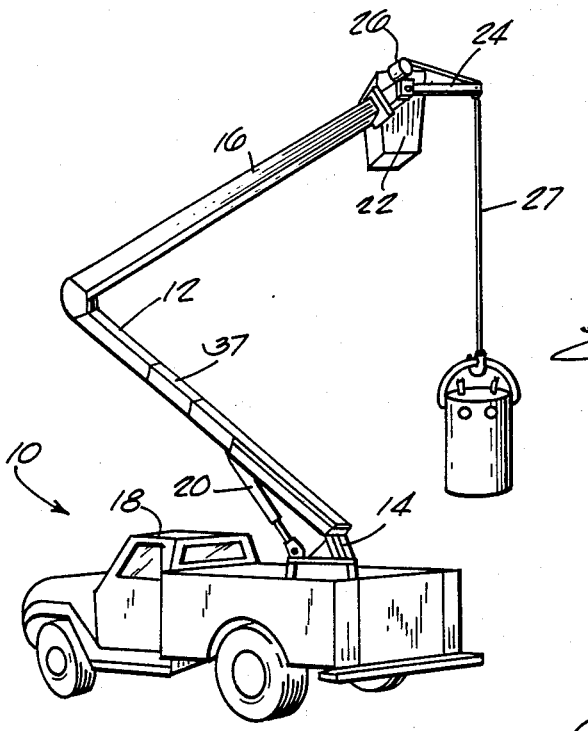
FIG. 1 is a perspective view of a truck mounted aerial lift embodying the invention.

Before describing a preferred embodiment of the invention in detail, it is to be understood that the invention is not limited to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is an aerial lift 10 embodying the invention and including a lower boom 12 supported by a turntable 14 and an upper boom 16 pivotally supported by the upper end of the lower boom 12 for articulated movement. The turntable 14 is supported in a conventional manner by a truck 18 or other supporting base, and an extensible lower boom cylinder 20 is provided for causing pivotable movement of the lower boom 12 about a horizontal pivot axis with respect to the turntable 14. The upper boom 16 has one end pivotally supported by the upper end of the lower boom 12 and includes an upper end adapted to support a bucket or platform 22 for supporting a workman. In some applications, the upper end of the boom may also support a jib 24, a winch 26 and an electrically insulated rope 27 for use by an operator in the bucket to lift or support equipment being installed or repaired.

The aerial lift 10 also includes means for supporting the upper boom 16 and for causing articulated movement of the upper boom 16 with respect to the lower boom 12, this means including a hydraulic cylinder 28 (FIG. 2) mounted in the lower boom 12 and having an extensible piston rod 30 connected to the upper boom by a cable or wire rope 32. A sheave 35 is mounted at the elbow or pivot axis of the boom assembly and the cable 32 is reeved over the sheave 35, one end of the cable 32 being fixed to the upper boom 16 by a bracket 34, and the opposite end of the cable being connected through an electrically insulating rod 36 to the piston rod 30 of the hydraulic cylinder 28 such that extension or retraction of the hydraulic cylinder 28 will cause pivotal movement of the upper boom 16 with respect to the lower boom 12 about pivot axis 38. The lower boom also includes an intermediate section 37 comprised of electrically insulative material such as fiberglass and the hydraulic cylinder is located in the lower boom between the intermediate section 37 and the lower end of the lower boom 12.

Compensation means are also provided for supporting the upper boom 16 such that the position of the upper boom 16 will remain substantially constant with respect to horizontal during pivotal movement of the lower boom 12 with respect to the turntable 14. More specifically, a compensation chain 40 is connected by a bracket 42 to the lower end of the hydraulic cylinder 28 and is reeved over an idler sprocket 44 supported by the lower boom and a sprocket sector 46. The lower end of the compensation chain 40 is fixed by a bracket 48 to the turntable 14. The sprocket sector 46 is supported by the turntable 14 at the lower boom pivot axis by a pivot pin 50 and has an effective radius with respect to that pivot axis which is the same as the effective radius of the sheave 35 at the elbow of the upper boom 16 and the lower boom 12. The upper boom actuating cylinder 28 is movable with respect to the lower boom 12 in the direction of its longitudinal axis and is connected to the compensating chain 40 such that as the lower boom 12 pivots with respect to the axis of the pivot pin 50, the cable 32 will cause compensating movement of the upper boom 16 such that the upper boom position with respect to horizontal will remain constant despite movement of the lower boom 16 about that pivot axis.

Means are also provided for sensing the hydraulic fluid pressure in the rod end of the upper boom cylinder and for producing a signal in response to sensing a hydraulic fluid pressure greater than an acceptable fluid pressure. In the illustrated arrangement, this means can include a pressure responsive switch 56 operably connected to the rod end of the upper boom lift cylinder 28 and functional to sense the hydraulic fluid pressure in the rod end of the upper boom lift cylinder. In operation of the pressure responsive switch 56, if the pressure in the rod end of the hydraulic cylinder 28 exceeds a predetermined fluid pressure, the switch 56 closes to trigger an alarm or provide some other signal indicating that the combination of the load on the boom and the relative position of the boom with respect to horizontal are generating a moment on the upper boom in excess of a selected moment.

Figure 2:
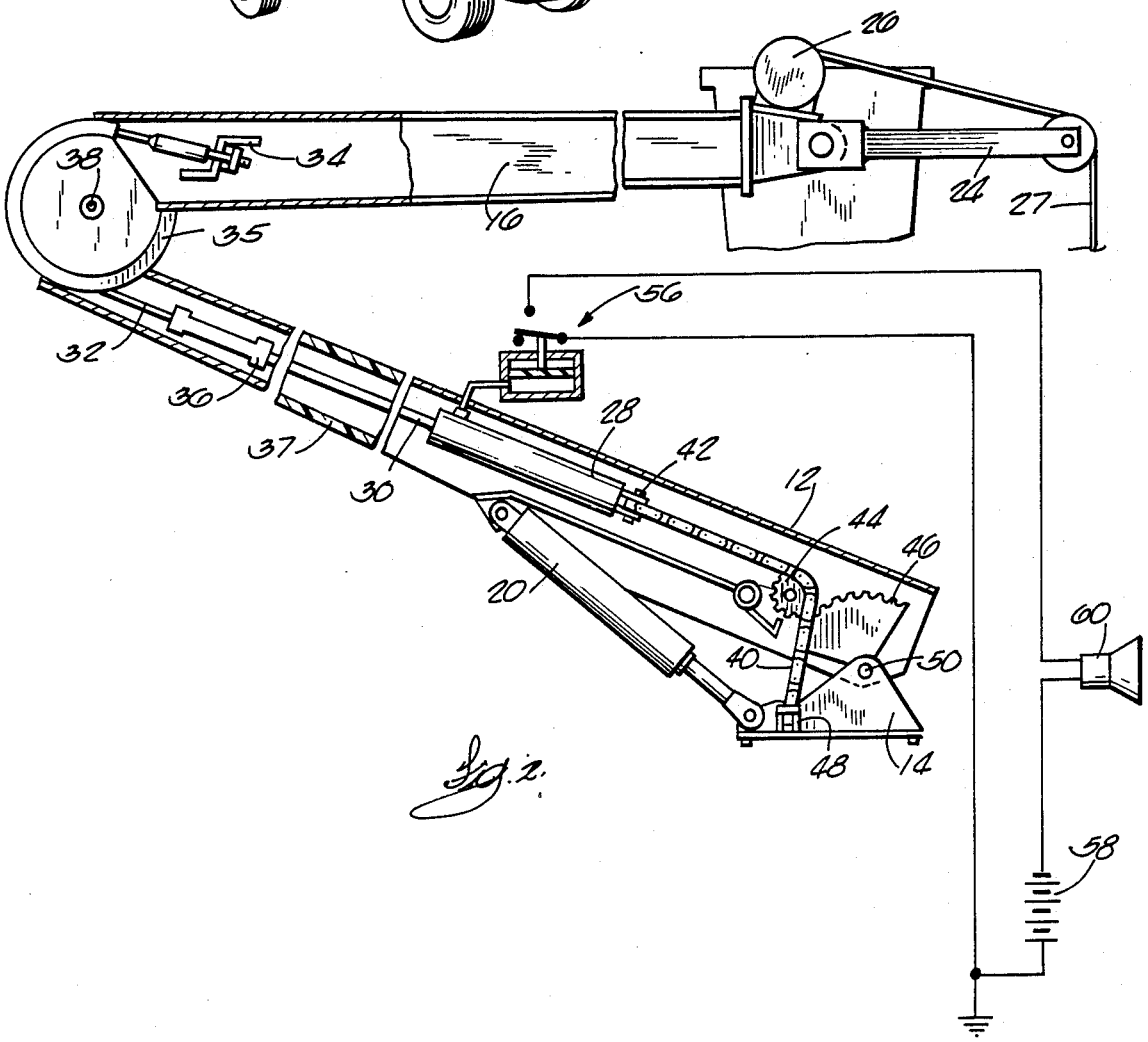
FIG. 2 is an enlarged schematic view of the aerial lift shown in FIG. 1.

In the embodiment of the invention shown schematically in FIG. 2, an electrical power source, such as a battery 58, is connected to an alarm horn 60, and the electrical circuit of the horn includes the pressure responsive switch 56. In the event that a load in excess of the capacity of the aerial lift and/or in the event the upper boom 16 is moved to a position wherein the moment arm length is sufficiently great that the aerial lift is overloaded, the alarm 60 will sound.

It will be appreciated by reference to the structure illustrated in FIG. 2 that the hydraulic fluid pressure in the rod end of the upper boom lift cylinder 28 is directly proportional to the combination of the load on the bucket and the relative position of the upper boom with respect to horizontal, and is independent of the relative position of the lower boom with respect to the turntable. Because the compensating mechanism including the chain 40, the sprocket sector 46, the idler sprocket 44 and the sheave 35 having a constant radius, provide a means for maintaining the upper boom 16 in a constant position with respect to horizontal regardless of the relative position or movement of the lower boom 12, the length of the moment arm between the bucket 22 and the axis of the elbow 38 remains constant during movement of the lower boom 12. Accordingly, the hydraulic fluid pressure in the rod end of the upper boom lift 28 cylinder is constant despite relative movement of the lower boom. Because this hydraulic fluid pressure in the rod end of the upper boom lift cylinder remains constant despite movement of the lower boom, the hydraulic fluid pressure sensor 56 operably connected to the upper boom lift cylinder will provide an accurate indication of a maximum or excessive load condition on the upper boom.

Figure 3:
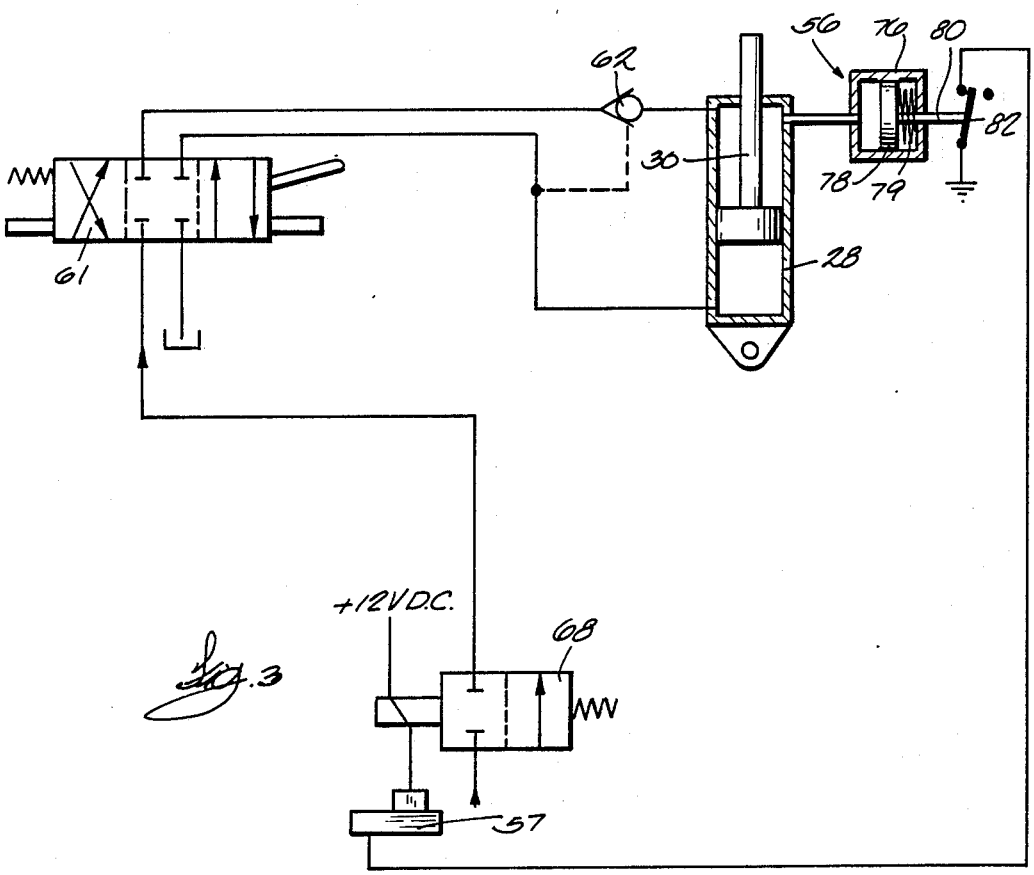
FIG. 3 is a schematic view of a hydraulic system and an electrical overload sensing and alarm system of the aerial lift shown in FIGS. 1–2.

Illustrated schematically in FIG. 3 is a hydraulic fluid circuit and an electrical circuit controlling operation of the upper boom lift cylinder 28. The hydraulic fluid circuit includes a main hydraulic fluid control valve 61 for controlling supply of hydraulic fluid to the upper boom lift cylinder 28. The control valve 61 is connected through a pilot operated check valve 62 to the rod end of the hydraulic cylinder, and to the opposite end of the hydraulic cylinder 28.

The hydraulic fluid circuit also includes a solenoid operated valve 68 controlling the supply of hydraulic fluid to the main control valve 61. The electrical control circuit for controlling operation of the solenoid operated valve 68 also includes the single pole two position switch 56 responsive to the hydraulic fluid pressure in the rod end of the upper boom lift cylinder 28, the pressure responsive switch 56 being connected through brushes 57 in the turntable 14 to the solenoid actuated valve 68. In the illustrated arrangement the pressure responsive switch 56 includes a pressure housing 76 having a piston 78, one side of the housing 76 being connected to the rod end of the upper boom lift cylinder. The piston controls movement of a single pole two position switch 80 such that when the hydraulic fluid pressure exceeds a selected pressure, a contact 82 will be opened thereby interrupting the electrical signal to the solenoid operated valve 68. The solenoid operated valve 68 will then interrupt supply of hydraulic fluid to the main control valve 60. A spring 79 normally biases the piston 78 toward a position wherein the contact 82 will be closed when the fluid pressure is reduced.

Figure 4:
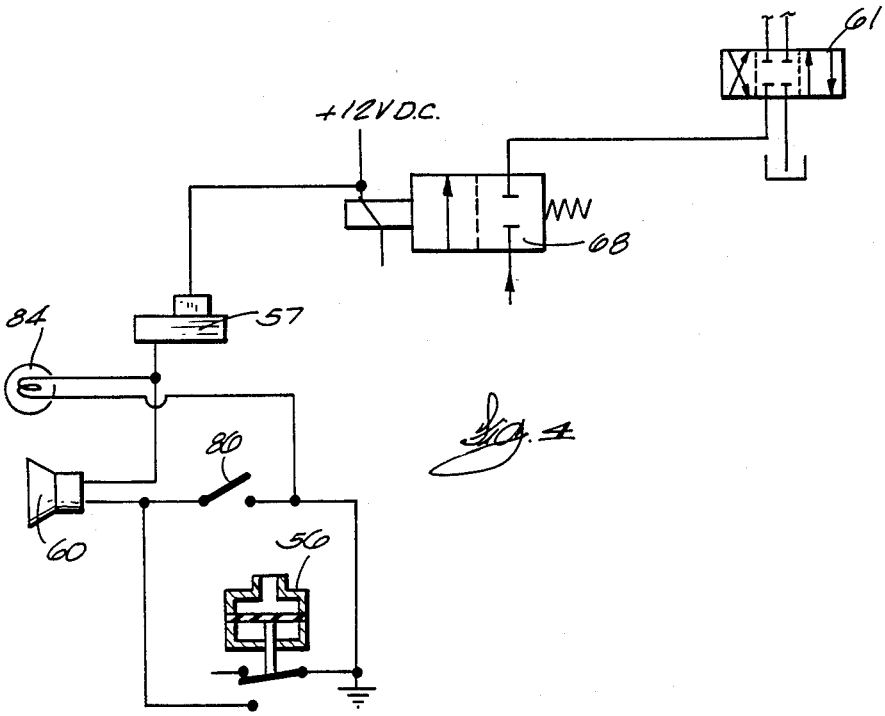
FIG. 4 is a view similar to FIG. 3 and showing an alternative embodiment of the overload sensing and alarm system shown in FIG. 3.

FIG. 4 illustrates an alternative embodiment of the invention including an alarm device 60 operably coupled to the hydraulic fluid pressure responsive switch 56. In the arrangement shown in FIG. 4, in the event the hydraulic fluid pressure in the hydraulic lift cylinder 28 exceeds a selected pressure, a warning horn 60 will sound, advising the operator that the combination of the load on the bucket 22 and the relative position of the upper boom are generating a moment on the upper boom in excess of a selected moment. In the arrangement shown in FIG. 4, the electrical circuit further includes a light 84 provided to indicate to the operator that electrical current is being supplied to the warning horn 60. In operation of the arrangement illustrated in FIG. 4, the warning horn 60 will sound in the event maximum hydraulic fluid pressure is sensed by the fluid pressure responsive switch 56 causing the switch to close. In the arrangement shown in FIG. 4, the electrical circuit also includes a manually operable test switch 86 to permit manual testing of the alarm horn to test its operability.

Figure 5:
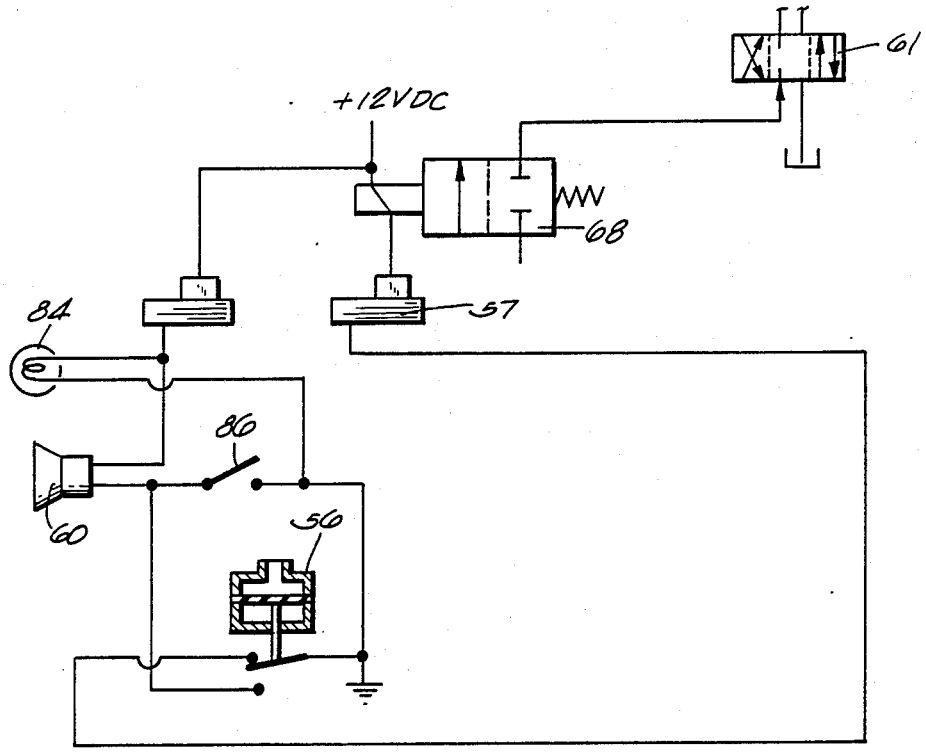
FIG. 5 is a view similar to FIGS. 3 and 4 and illustrating another alternative embodiment of the invention.

FIG. 5 is a schematic illustration similar to that in FIG. 4 and showing another alternative embodiment of the invention wherein the hydraulic fluid pressure responsive switch 56 functions to sound a warning alarm 60 and also to interrupt supply of hydraulic fluid to the main control valve 60. The arrangement shown in FIG. 5 is similar to that explained above in connection with FIG. 4, except that the control circuit for the solenoid operated valve 68 includes the normally closed contacts within pressure responsive switch 56. In the event the switch opens, the electrical current to solenoid operated valve 68 will be interrupted to thereby interrupt flow of hydraulic fluid to the main control valve 60. Additionally, the pressure responsive switch 56 will also close the electrical circuit providing current to the alarm horn 60.

Various features of the invention are set forth in the following claims.

I claim:

1. An aerial lift comprising:

a support structure;

a lower boom having an upper end and a lower end, the lower end of the lower boom being pivotally joined to the support structure for pivotal movement about a horizontal axis;

means for causing pivotal movement of the lower boom with respect to the support structure;

an upper boom having opposite ends, one end being pivotally joined to the upper end of the lower boom for pivotal movement about a pivot axis and an upper end adapted to support a load;

means for causing pivotal movement of the upper boom with respect to the lower boom, the means for causing pivotal movement including a hydraulic cylinder having opposite ends, the means for causing movement of the upper boom with respect to the lower boom including a sheave supported by the upper end of the lower boom, the sheave having a radius about the pivot axis, and a cable reeved over the sheave, the cable having opposite ends, one end connected to the upper boom and the opposite end connected to one end of the hydraulic cylinder;

compensating means for maintaining the upper boom in a selected position with respect to horizontal during movement of the lower boom with respect to the support structure; the compensating means including a flexible member having opposite ends, one end of the flexible member being fixed to the support structure and an opposite end of the flexible member being fixed to an opposite end of the hydraulic cylinder, and a curved support member supported by the support structure and having a curved surface for supporting a portion of the flexible member, and the curved surface having a radius about the horizontal pivot axis substantially the same as the radius of the sheave; and, means for providing a signal when the combination of the load on the upper boom and the relative position of the upper boom with respect to horizontal generates a moment in excess of a selected moment.

2. An aerial lift as set forth in claim 1 wherein the means for providing a signal includes a sensor for sensing the hydraulic fluid pressure in the hydraulic cylinder.

3. An aerial lift as set forth in claim 2 and further including alarm means operably connected to the sensor for producing an alarm signal in response to a signal from the sensor and operable to provide an alarm when the combination of the load on the upper boom and the relative position of the upper boom with respect to horizontal generates a moment in excess of a selected maximum moment.

4. An aerial lift as set forth in claim 2 and further including means for interrupting movement of the upper boom, said means for interrupting movement being operably connected to the means for providing a signal and for interrupting operation of the upper boom in the event the moment on the upper boom exceeds a maximum selected moment.

5. An aerial lift as set forth in claim 1 wherein the lower boom includes a portion intermediate the upper end and the lower end of the lower boom comprised of insulative material, and wherein the hydraulic cylinder is housed in the lower boom between the insulative material and the lower end of the boom.

6. An aerial lift comprising:

a support structure;

a lower boom having an upper end and a lower end, the lower end of the lower boom being pivotally joined to the support structure for pivotal movement about a horizontal axis;

means for causing pivotal movement of the lower boom with respect to the support structure;

an upper boom having opposite ends, one end being pivotally joined to the upper end of the lower boom for pivotal movement about a pivot axis, and an upper end adapted to support a load;

means for causing pivotal movement of the upper boom with respect to the lower boom, the means for causing pivotal movement including a hydraulic cylinder and a sheave pivotable about the pivot axis of the upper boom, the sheave having a radius and a cable reeved over the sheave, the cable having opposite ends, one end connected to the upper boom, and the opposite end connected to the hydraulic cylinder;

compensating means for maintaining the upper boom in a selected position with respect to horizontal during movement of the lower boom with respect to the support structure, said compensating means including a sprocket means supported by the support structure, the sprocket means having a radius about said horizontal pivot axis substantially the same as the radius of the sheave, a flexible member reeved over at least a portion of the sprocket means, the flexible member having opposite ends, one end fixed to the support structure and an opposite end connected to the hydraulic cylinder; and, means for providing a signal when the combination of the load on the upper boom and the relative position of the upper boom with respect to horizontal generates a moment in excess of a selected moment.

7. An aerial lift as set forth in claim 6 wherein the means for providing a signal includes a sensor for sensing the hydraulic fluid pressure in the hydraulic cylinder.

8. An aerial lift as set forth in claim 7 and further including alarm means operably connected to the sensor for producing an alarm signal in response to a signal from the sensor and operable to provide an alarm when the combination of the load on the upper boom and the relative position of the upper boom with respect to horizontal generates a moment in excess of a selected maximum moment.

9. An aerial lift as set forth in claim 7 and further including means for interrupting movement of the upper boom, said means for interrupting movement of the upper boom being operable connected to the means for providing a signal and for interrupting operation of the upper boom in the event the moment on the upper boom exceeds a maximum selected moment.

10. An aerial lift as set forth in claim 6 wherein the lower boom includes a portion intermediate the upper end, and the lower end of the lower boom being comprised of insulative material, and wherein the hydraulic cylinder is housed in the lower boom between the insulative material and the lower end of the lower boom.

* * * * *